US005616272A

United States Patent [19]

McCrystal

[11] Patent Number: 5,616,272

[45] Date of Patent: Apr. 1, 1997

[54] RE-BAR ALIGNMENT AND SUPPORT CLIP

[76] Inventor: Philip J. McCrystal, 1257 Tobias Dr., Chula Vista, Calif. 91911

[21] Appl. No.: 427,221

[22] Filed: Apr. 21, 1995

[51] Int. Cl.[6] ..... E04G 17/00; E04B 1/41

[52] U.S. Cl. ..... 249/207; 249/91; 249/93; 52/677; 52/699

[58] Field of Search ..... 249/91, 93, 207, 249/219.1, 210; 52/699, 698, 677

[56] References Cited

U.S. PATENT DOCUMENTS

| | | | |
|---|---|---|---|
| 3,197,171 | 7/1965 | Michalak | 249/91 |
| 4,391,429 | 7/1983 | Powell | 249/91 |
| 4,689,867 | 9/1987 | Tollirer | 249/91 |
| 5,042,218 | 8/1991 | Nasca et al. | 52/677 |
| 5,337,534 | 8/1994 | Nasca | 52/745.21 |
| 5,388,804 | 2/1995 | Cohen et al. | 249/93 |

FOREIGN PATENT DOCUMENTS

| | | | |
|---|---|---|---|
| 2317064 | 11/1977 | France | 249/91 |

*Primary Examiner*—Khanh P. Nguyen
*Attorney, Agent, or Firm*—Charles C. Logan, II

[57] ABSTRACT

A re-bar alignment and support clip for re-bar members that need to extend vertically upwardly from a concrete foundation. The re-bar alignment support clip is detachably secured on the horizontal 2×4 whose bottom surface is generally flush with the top surface of the concrete foundation. The re-bar alignment and support clip has a pair of vertically spaced spring arm portions each having an intermediate curved recess that passes around the re-bar and keeps it vertically oriented.

11 Claims, 7 Drawing Sheets

RE-BAR ALIGNMENT AND SUPPORT CLIP

BACKGROUND OF THE INVENTION

The invention relates to a re-bar clip and more specifically to one that is used for both supporting vertically oriented re-bar members and properly aligning these vertically oriented re-bar members.

When forming concrete footings upon which bricklayers will build a wall from concrete blocks, it is necessary that the re-bar members extending up from the footing be oriented substantially perpendicular to the top surface of the concrete footing. These re-bar members have an L-shaped structure having a vertical leg and a horizontal leg. These re-bar members are installed on 16 inch centers along the length of the footing. If the vertical portion of the re-bar member is not substantially vertical, the bricklayer will have to bend this portion of the re-bar until it is properly oriented.

The manner in which the L-shaped re-bar members are presently secured in place requires a two man team. Both of these men are in the trench into which the concrete is poured to form the footing. One man holds the upper leg of the re-bar vertical while the other man secures it to a horizontally oriented 2×4 whose bottom surface defines the upper surface of the concrete footing to be poured. The vertical section of the re-bar is tied to the 2×4 with flexible light wire that is doubled over upon itself to form a double thickness. This wire is then wound around the vertical portion of the re-bar below the 2×4 and then up over the back of the 2×4, over its top, and down over its front side. The man tying the wire then uses his side-cutters to cut the excess wire. It requires approximately 2 to 3 minutes for each piece of wire to be tied and also involves a two man operation.

Once the concrete is poured, it is necessary to remove the stakes and 2×4 before the concrete has set. Now all of the steel wire that has been tied to the 2×4 must be removed. This is done by cutting the wire so that the 2×4 can be removed. This procedure leaves pieces of the wire extending up from the top surface of the concrete footing. Before the bricklayers lay block on the top surface of the concrete footing, the ends of the wire sticking out must be cut off. This requires additional labor time since it is imperative that a good clean foundation surface be formed so the bricklayers have a clean surface for snapping a chalk line on the footing before building the wall.

Presently there exists re-bar support members in the form of a hanger such as illustrated in U.S. Pat. No. 5,042,218. These hangers are only used for supporting horizontally extending re-bar steel members. Once the concrete has set, the top portion of the hanger is snapped off so that the form can be removed.

It is an object of the invention to provide a novel re-bar alignment and support clip that can be quickly and easily installed by one man to hold L-shaped re-bar members in their proper position.

It is also an object of the invention to provide a novel re-bar alignment and support clip that can be quickly and easily removed from the horizontal 2×4 to which it is secured after the concrete has begun to set.

It is another object of the invention to provide a novel re-bar alignment and support clip that can be used several times.

It is an additional object of the invention to provide a novel re-bar alignment and support clip that will save time and money during the process of building a footing upon which a concrete block wall would be built.

It is a further object of the invention to provide a re-bar alignment and support clip that is economical to manufacture and market.

SUMMARY OF THE INVENTION

The novel re-bar alignment and support clip has been designed to be utilized with L-shaped re-bar members that have their horizontal leg portion captured in the concrete footing and their vertical leg member extending upwardly perpendicular to the top surface of the footing. These re-bar alignment and support clips are economical to manufacture and market and are also reusable. They eliminate the time consuming operation of tying wire around the vertical portion of the re-bar member and securing it to the horizontal 2×4 that forms the top of the concrete footing.

The novel re-bar alignment and support clips eliminate the costly operation of having to clip the portions of the wire extending above the top of the footing that had been used to secure the re-bar in position prior to pouring the concrete. The structure of the re-bar alignment and support clip ensures that each of the top portions of the re-bar members are properly aligned in a vertical position each time.

The re-bar alignment and support clip has an upper spring arm portion whose rear end is connected to one of the downwardly extending leg members of the rear inverted U-shaped retainer portion. A leg member extends forwardly from the bottom end of the other leg of the rear inverted U-shaped retainer portion. The front end of this leg member is connected to the front inverted U-shaped retainer portion. A lower spring arm portion has its front end connected to the bottom end of the finger gripping portion whose top end is in turn connected to the front end of the upper spring arm portion. The re-bar clip is preferably made from spring steel having a generally circular cross section. It is made in a unitary member from a length of spring steel in the general range of 10 to 30 inches. The finger-gripping portion aids in installing and removing the re-bar clip. The spring arm portions have curved recesses intermediate their length to guide or align the vertical portion of the re-bar that is to be captured by the clip.

The manner in which the re-bar clip is installed is very simple. The front and rear inverted U-shaped retainer portions are slid downwardly over the top of the 2×4 whose bottom surface will define the top surface of the footing. The finger gripping portion is pulled laterally during installation on the 2×4 so that the vertical leg of the re-bar can be captured in the curved recesses of the spring arm portions. When the vertical leg is in position, the spring arm portions are allowed to snap back against the vertical surface of the 2×4. When each of the many vertical legs of the re-bar members have been properly positioned against the 2×4, the concrete can be poured to form the footing and its top surface will rise no higher than the bottom surface of the 2×4. Once the concrete has properly set, the re-bar clip can be easily removed by grabbing the finger gripping portion and pulling it laterally a sufficient distance to pass the vertical portion of the re-bar member and allow the clip to be removed from the top of the 2×4. The re-bar clip can be used over and over again. There is no clean up cutting of wire required as is necessary when steel wire is used to tie the vertical portions of the re-bar members to the 2×4.

DESCRIPTION OF THE PREFERRED EMBODIMENT

The novel re-bar alignment and support clip will now be described by referring to FIGS. 1–6 of the drawings. The re-bar alignment and support clip is generally designated numeral 10.

Figure 1:
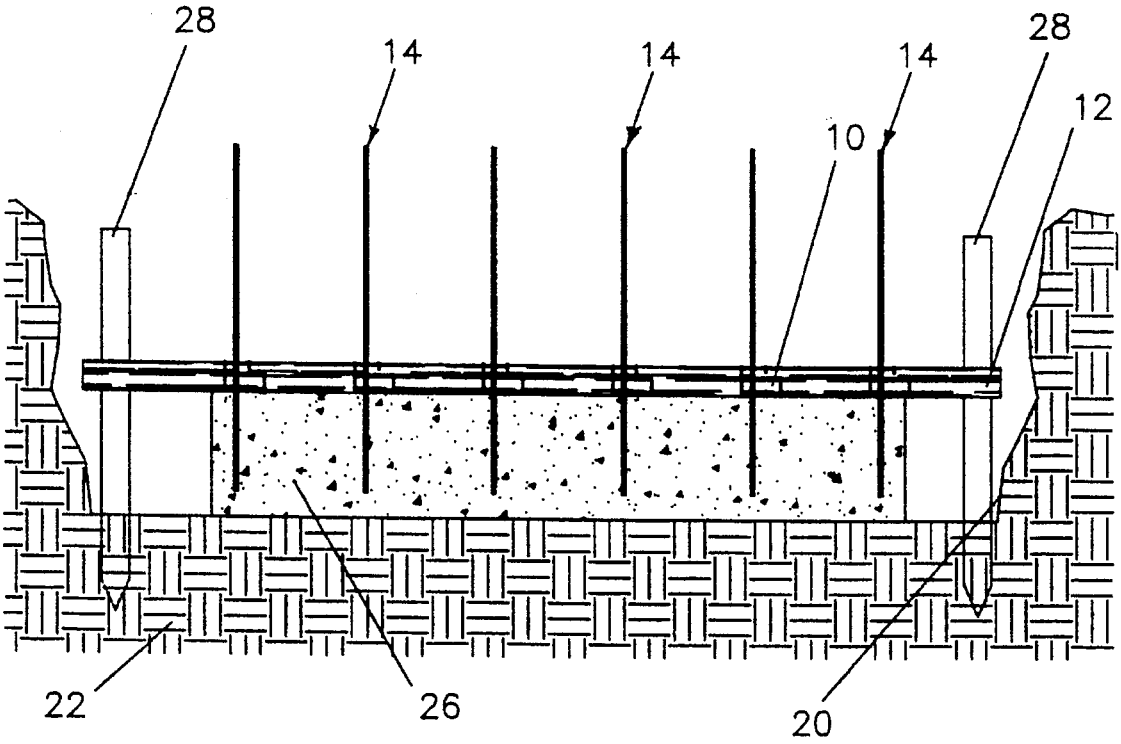
FIG. 1 is a schematic side elevation view illustrating the manner in which the re-bar alignment and support clips are secured to a horizontal 2×4.
Figure 2:
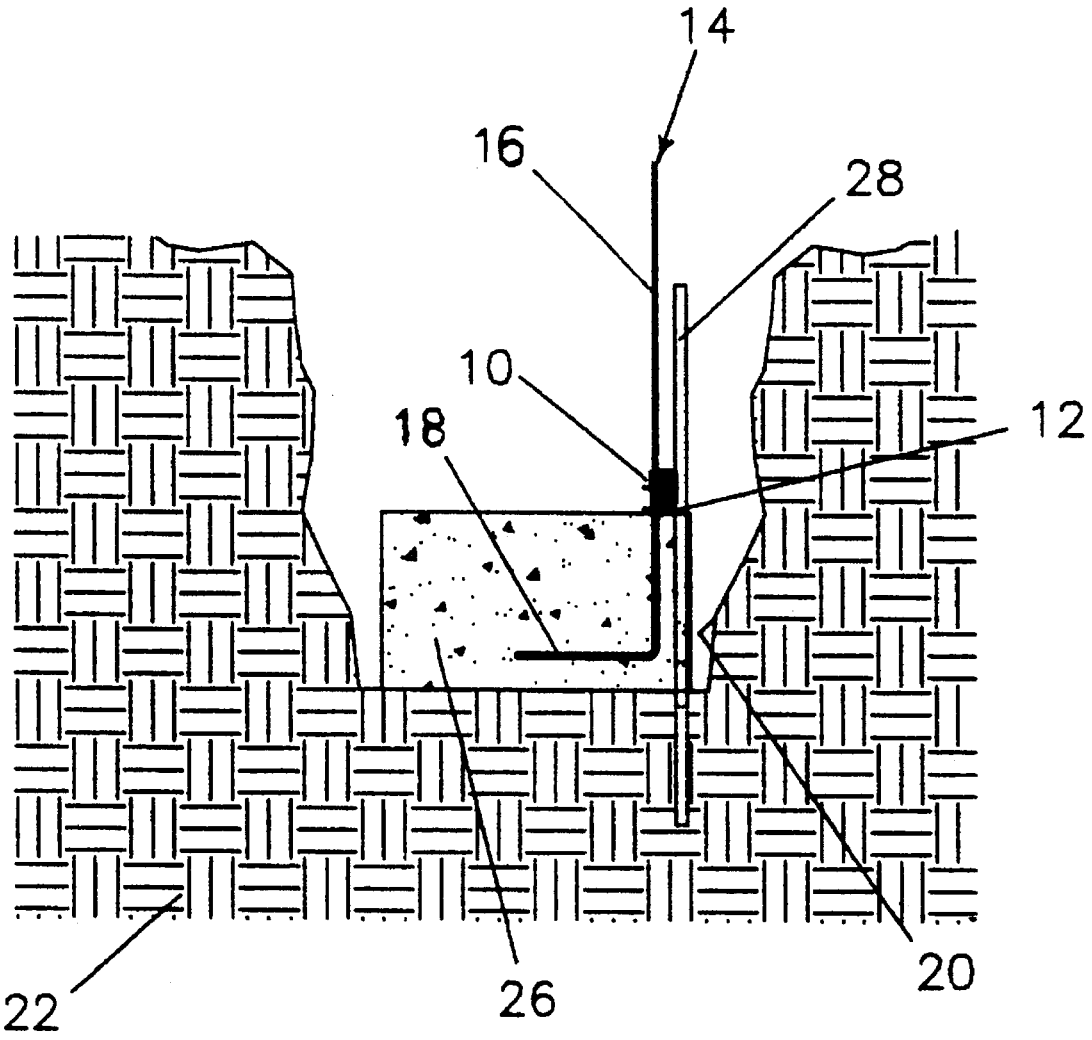
FIG. 2 is a schematic end elevation view showing the manner in which the re-bar alignment and support clip is secured to the 2×4.

In FIGS. 1 and 2, a plurality of re-bar alignment and support clips 10 are illustrated secured on a substantially horizontal 2×4 identified by numeral 12. These clips 10 each secure a vertically oriented re-bar member 14 having an L-shaped configuration. Each re-bar member has a vertical leg 16 and a horizontal leg 18. A ditch 20 is dug in the soil 22 and a concrete footing 26 is formed in the ditch. The 2×4 member 12 is held in a horizontal position by stakes 28 that have been driven into the soil 22.

Re-bar alignment and support clip 10 has an upper spring arm portion 36 having a length L1. It has a rear section 38 having an longitudinally extending axis and it has a length L3. Front section 40 has a length L4. Intermediate rear section 38 and front section 40 is a curved recess 42 that mates with the round curvature of the re-bar member 14 between a pair of its vertically spaced outwardly extending annular ribs. A finger gripping portion 44 extends downwardly from the front end of front section 40. A lower spring arm portion 66 also has a length L1. It has a rear section 70 having a longitudinally extending axis and a length L3. Front section 68 has a length L4. Intermediate rear section 70 and front section 68 is a curved recess 71 that also mates with the round curvature of the re-bar member 14. Upper spring arm portion 36 and lower spring arm portion 66 are substantially identical in shape. The front end of front section 68 is connected to the bottom end of finger gripping portion 44. A leg member 72 extends upwardly from the rear end of rear section 70.

An inverted U-shaped primary retainer portion 46 has laterally spaced downwardly extending legs 48 and 49. Their top ends are connected together by a cross member 50 having a predetermined width W1. Downwardly extending leg 48 has a predetermined height H1 and downwardly extending leg 49 has a predetermined height H2. Extending forwardly from the bottom end of leg 49 is a longitudinally extending leg 52. Extending upright from its front end is a leg member 54 that forms a portion of secondary inverted U-shaped retainer portion 56. A cross member 58 extends horizontally from the top end of leg member 54 and it has a width W2. A leg member 60 extends downwardly from the front end of cross member 58.

Cross members 50 and 58 are substantially equal in length. In a typical re-bar alignment support clip, W1 and W3 would be approximately 1.55 inches. H1 would be approximately 1.5 inches and H2 would be approximately 3.0 inches which is less than the height of a 2×4 by approximately ¾ inch. L1 would be in the range of 3–7 inches. Angles A and B would normally be approximately 90 degrees but could be in the range of 60–120 degrees.

Figure 3:
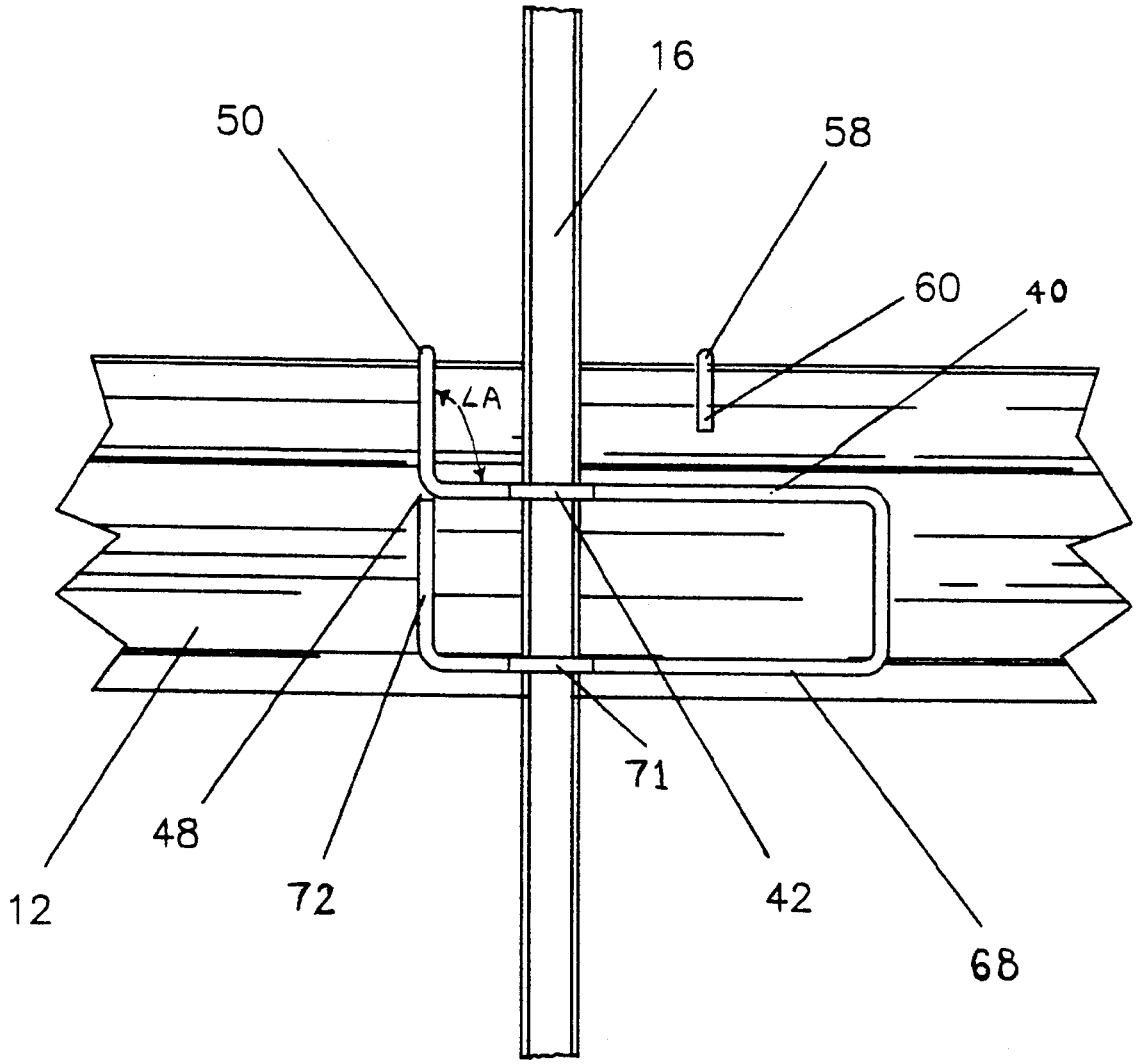
FIG. 3 is a left side elevation view illustrating the re-bar alignment and support clip secured on a 2×4.
Figure 4:
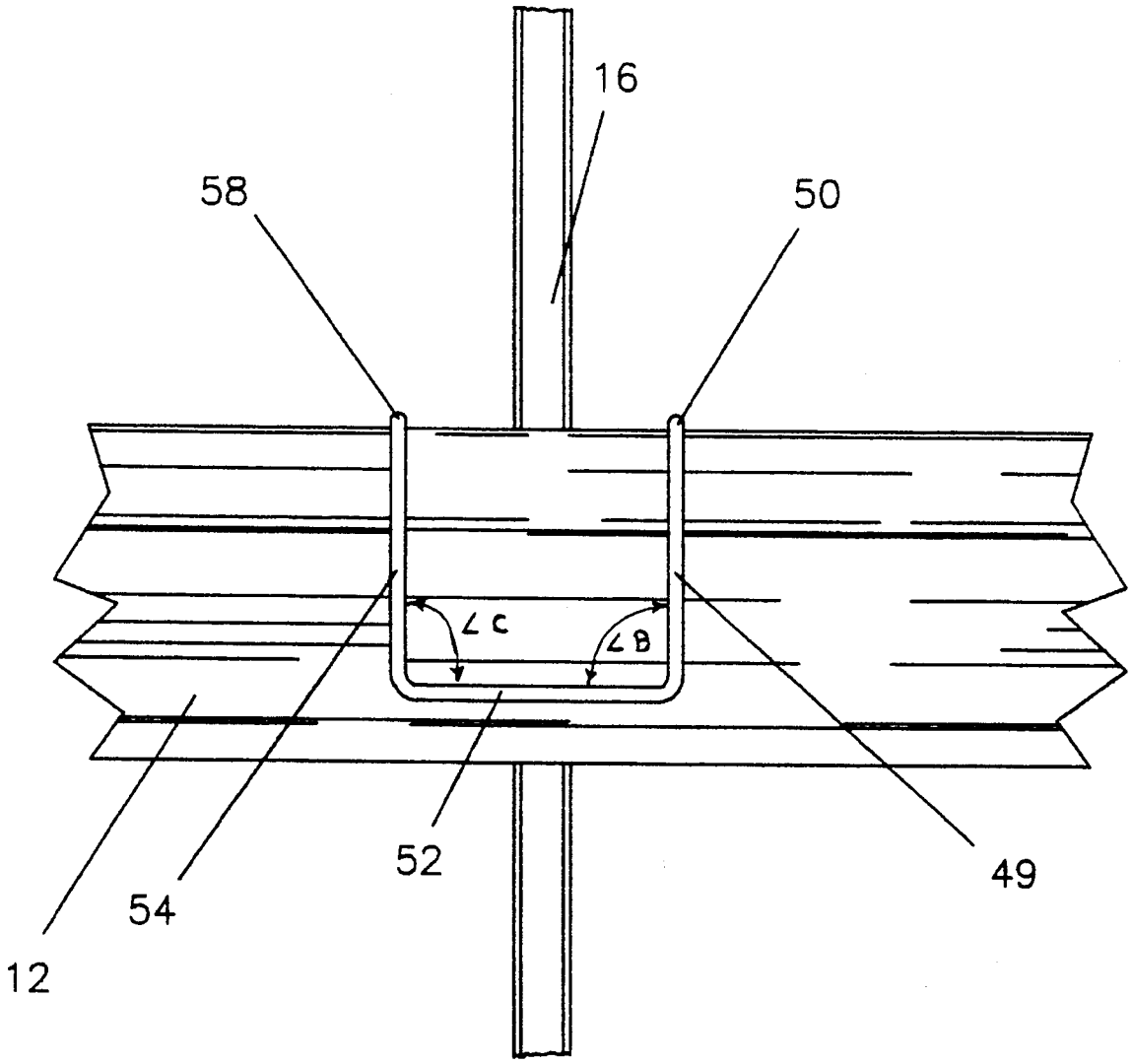
FIG. 4 is a right side elevation view of the re-bar alignment and support clip showing the side opposite to that illustrated in FIG. 3.
Figure 5:
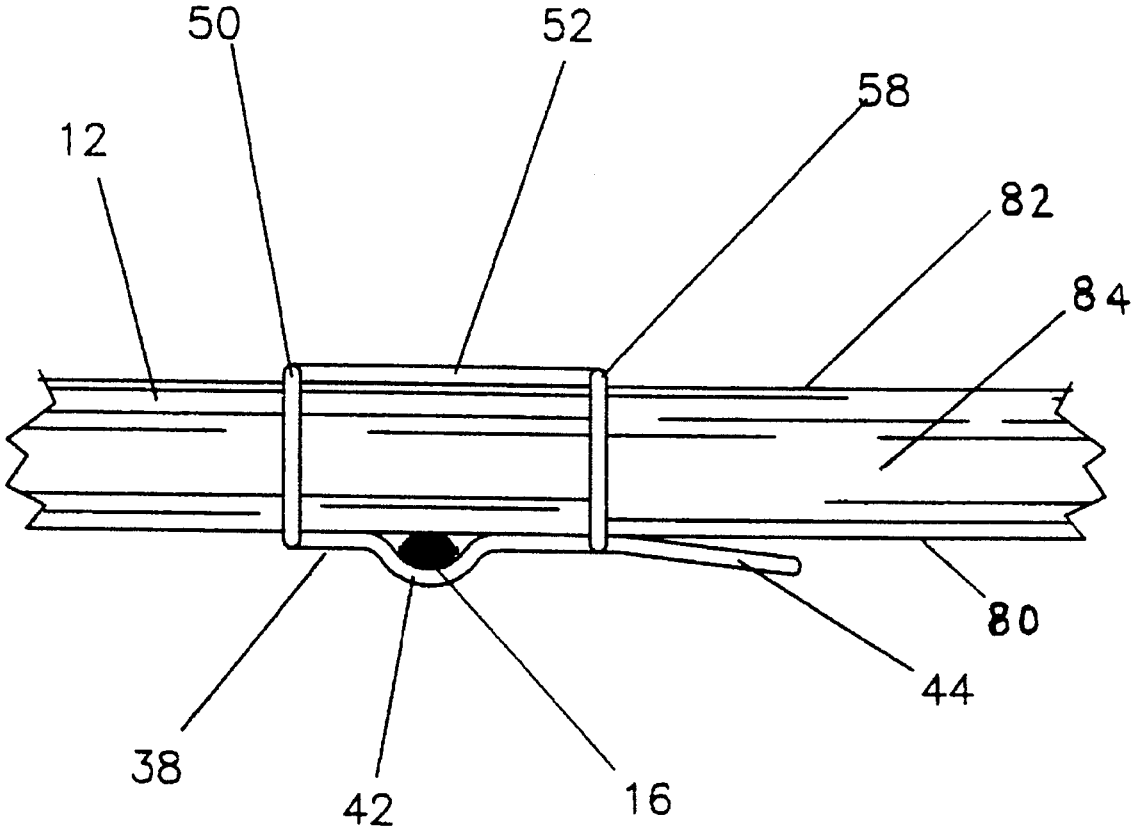
FIG. 5 is a top plan view showing the re-bar alignment and support clip secured to a 2×4.
Figure 6:
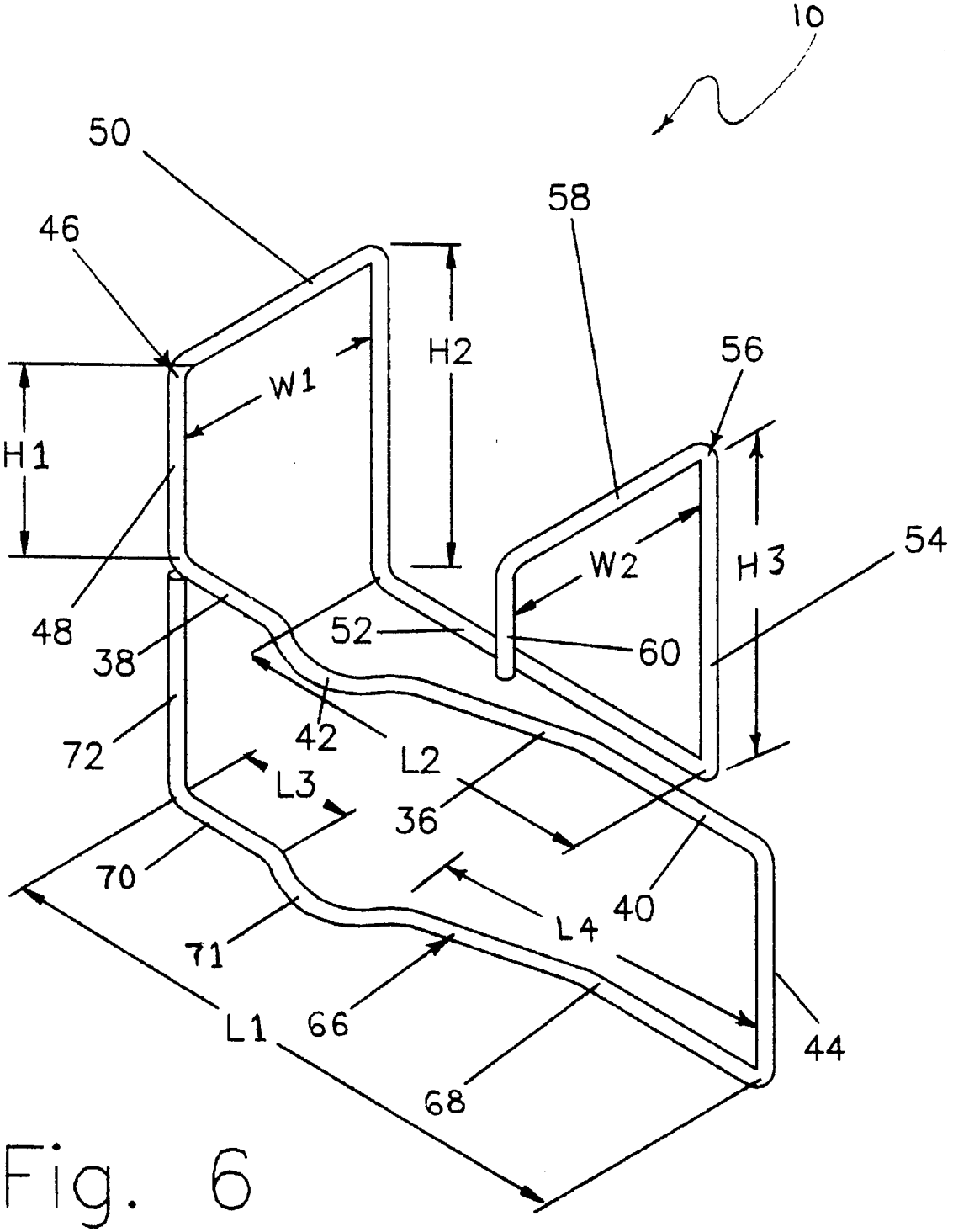
FIG. 6 is a front perspective view of the novel re-bar alignment and support clip.
Figure 7:
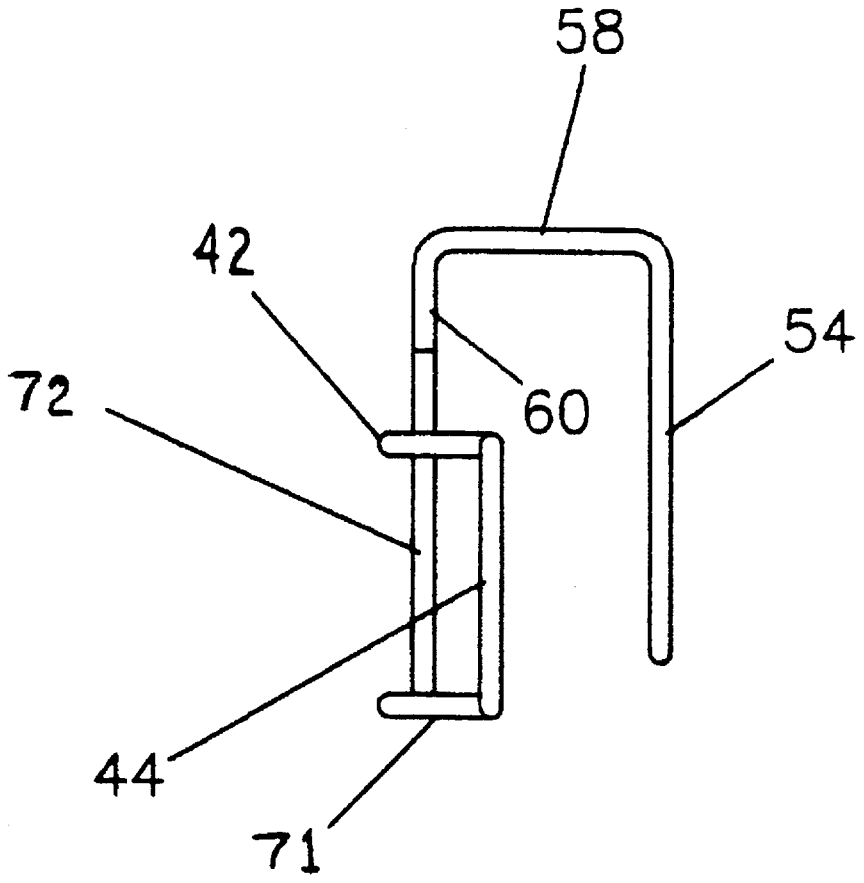
FIG. 7 is a side view of the re-bar alignment and support clip as shown in FIG. 6.

The manner in which the re-bar alignment and support clip 10 is secured to 2×4 member 12 is best illustrated by referring to FIGS. 3–5. 2×4 member 12 has a front wall 80, a rear wall 82 and a top wall 84. Curved recesses 42 and 71 captures vertical section 16 of the re-bar member 14. By pulling finger gripping portion 44 laterally, spring arm portions 36 and 66 are bent outwardly from 2×4 member 12 and vertical section 16 of the re-bar member. Clip 10 can then be easily removed by lifting upwardly on the spring arm portions which allows retainer portions 46 and 56 to pass upwardly off the top of 2×4 member 12. The manner of installing the clips would be substantially the reverse of the removal process.

What is claimed is:

1. A re-bar alignment and support clip device for positioning and holding securely an L-shaped re-bar member having a vertical leg and a horizontal leg; said device being detachably secured to a horizontally oriented 2×4 having a front wall, a rear wall, and a top wall; said 2×4 being secured to a pair of laterally spaced stakes extending upwardly from a ditch into which a concrete footing is to be poured and upon which a wall of concrete blocks would be built; the bottom surface of the 2×4 defines the top surface of the concrete footing that is to be poured; said device comprising:

at least one elongated spring arm portion that would extend along and contact the front wall of the 2×4; said spring arm having a front end, a rear end and a predetermined length L1;

an inverted U-shaped primary retainer portion oriented transversely to said spring arm portion and having laterally spaced downwardly extending first and second leg members each having a top end and a bottom end; a first cross member having a front end and a rear end and these respective ends are connected to the respective top ends of said downwardly extending leg members; the bottom end of said first leg member being connected to the rear end of said elongated spring arm portion at a predetermined angle A; said first leg would extend upwardly along the front wall of the 2×4; said second leg would extend downwardly along the rear wall of the 2×4 and said first cross member would extend across the top wall of the 2×4; a third leg member having a front end and a rear end, said rear end being transversely oriented to and connected the bottom end of said second leg member at a predetermined angle B; said third leg member having a predetermined length L2 extending along the rear wall of the 2×4 in the same general direction as that of the front end of said elongated spring arm portion; and said spring arm portion has a rear section having a length L3 and a front section having a length L4 and interconnecting said front and rear sections is an outwardly curved recess that mates with the round curvature of the vertical leg of an L-shaped re-bar member.

2. A re-bar alignment and support clip as recited in claim 1 wherein its structure is formed from a unitary rod member made of spring steel.

3. A re-bar alignment and support clip as recited in claim 2 wherein said rod member has a substantially circular cross section.

4. A re-bar alignment and support clip as recited in claim 1 further comprising a finger gripping portion connected to the front end of said spring arm portion transversely.

5. A re-bar alignment and support clip as recited in claim 1 wherein said spring arm portion lies in a substantially horizontal plane.

6. A re-bar alignment and support clip as recited in claim 1 wherein angles A and B are in the range of 60 degrees to 120 degrees.

7. A re-bar alignment and support clip as recited in claim 1 wherein L1 is greater than L2.

8. A re-bar alignment and support clip as recited in claim 1 wherein said first leg member has a height H1 and said second leg member has a height H2 and H2 is greater than H1.

9. A re-bar alignment and support clip as recited in claim 1 further comprising a fourth leg member having a height H3 and a top end and a bottom end, said bottom end being connected transversely to the front end of said third leg member at an angle C.

10. A re-bar alignment and support clip as recited in claim 9 further comprising a second cross member having a front end and a rear end, said rear end being transversely connected to the top end of said fourth leg member.

11. A re-bar alignment and support clip as recited in claim 10 further comprising a fifth leg member having a top end that is transversely connected to the front end of said second cross member.

* * * * *